US006629775B2

(12) United States Patent
Choikhet et al.

(10) Patent No.: US 6,629,775 B2
(45) Date of Patent: Oct. 7, 2003

(54) METHOD AND APPARATUS FOR MIXING FLUIDS

(75) Inventors: Konstantin Choikhet, Karlsruhe (DE); Gerard Rozing, Karlsruhe (DE)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/903,963

(22) Filed: Jul. 12, 2001

(65) Prior Publication Data

US 2002/0021620 A1 Feb. 21, 2002

(30) Foreign Application Priority Data

Jul. 20, 2000 (EP) ..... 00115614

(51) Int. Cl.[7] ..... B01F 5/06
(52) U.S. Cl. ..... 366/336; 366/337
(58) Field of Search ..... 366/336, 337

(56) References Cited

U.S. PATENT DOCUMENTS 3,394,924 A * 7/1968 Harder
3,404,869 A * 10/1968 Harder
3,427,002 A * 2/1969 Wilding ..... 366/336
3,476,521 A * 11/1969 Wise
3,857,551 A 12/1974 Troy
3,924,989 A * 12/1975 Althausen et al.
4,050,676 A * 9/1977 Morishima et al. ..... 366/339
4,198,168 A * 4/1980 Penn ..... 366/336
4,316,673 A * 2/1982 Speer ..... 366/337
5,534,328 A * 7/1996 Ashmead et al.
5,775,805 A * 7/1998 Furuya
6,392,007 B1 * 5/2002 Buchanan et al.

FOREIGN PATENT DOCUMENTS

GB 2 018 609 A 10/1979

* cited by examiner

*Primary Examiner*—Tony G. Soohoo

(57) ABSTRACT

Disclosed is a mixing apparatus where a fluid is progressing from an Inlet tubing to an Outlet tubing. Every segment of the liquid is part by part transferred to the Outlet channel via numerous restrictor channels. The distances between the restrictor channels determine a dispersion pattern for any segment of the flow, progressing from the inlet chamber in the form of a reservoir channel to the Outlet. The nearer the outlet channels are placed one to another, the higher is the permeability to the outlet collector at the respective location. Delaying partial flows of the fluid with different flow delays and providing different flow volumes for the partial flows results in a predetermined flow distribution function thus determining a dispersion pattern. This allows for a continuous dispersion of a fluid property which is intended to be mixed, in accordance with a predefined fluid distribution function.

4 Claims, 7 Drawing Sheets

ACN after Mixer

ACN, %
1.010
1.008
1.006
1.004
1.002
1.000
0.998
0.996
0.994
0.992
0.990
0
1
2
3
4
5
6
7
Time, min
Mixer
0.0020
0.0015
0.0010
0.0005
0.0000
0.0 0.2 0.4 0.6 0.8 1.0 1.2 1.4 1.6 1.8

Initial ACN

ACN, %
1.020
1.015
1.010
1.005
1.000
0.995
0.990
0.985
0.980
0
1
2
3
4
5
6
7
Time, min

METHOD AND APPARATUS FOR MIXING FLUIDS

BACKGROUND OF THE INVENTION

1. Field of the Invention

The present invention relates to a method and apparatus for mixing a fluid, particularly a liquid or a gas, whereby the fluid comprises at least one physical and/or chemical fluid property varying along a flow direction of the fluid.

2. Discussion of the Background Art

As shown in previous theoretical and experimental investigations, the fluctuations of the mixing ratio in an eluent flow generated by a high-pressure liquid-cromatography (HPLC-) pump can lead to undesired base line noise. For certain applications, e.g. separations using eluents with UV-absorbing additives, the strict requirements to the constancy or smoothness of the eluent composition over the separation time cannot be satisfied without using additional mixing appliances which disperse the zones with fluctuations of the eluent composition.

Methods and apparatus for mixing liquids or gases, particularly for smoothing fluctuations of physical or chemical properties like temperature and concentration along a flow, are known in the prior art, e.g. in technical areas like liquid chromatography or microfluidics.

In particular, JP 54-128863 A discloses a liquid mixing apparatus for mixing two liquids with different physical properties, e.g a high-temperature fluid with a low-temperature fluid or two fluids differing from each other in density or concentration, in order to obtain mixed fluids comprising an homogenous temperature profile along the axis of flow direction. Hereby a high-temperature liquid is introduced through an inflow port and flows out through an outflow port while throttled by a valve at a short circuit.

In that apparatus, the fluid introduced through the inflow port is split into two partial flows. One of the partial flows is delayed by letting it flow a longer bypass than the other partial flow, and joining both partial flows together again.

The drawback of that known apparatus is that it can mix the two partial flows efficiently only at certain singular frequencies of periodic fluctuations. Further, for its operation a duty cycle of the corresponding fluctuation of approximately 50% is required.

SUMMARY OF THE INVENTION

It is therefore an object of the present invention, to provide a method and an apparatus which allow for mixing of a fluid like a liquid or a gas with a predetermined and freely choosable mixing profile along the axis of flow direction.

Another object is to provide a method and an apparatus for smoothing of fluctuations of at least one physical property of such a fluid with a maximum fluctuation-smoothing effect.

A still another object is to provide such a method and apparatus for mixing of the earlier delivered parts of a flow with the following parts of the flow within a certain volume in accordance with any desired mixing function like a Gauss or similar mixing or filtering function.

It is still another object to provide such a method and apparatus which allow mixing with a minimum delay time.

These objects are solved by the features of the independent claims. Advantageous embodiments are subject matter of the subclaims. in particular, the method according to the invention comprises the steps of delaying partial flows of the fluid with different flow delays and providing different flow volumes for the partial flows thus resulting in a predetermined flow distribution function thus determining a dispersion pattern.

The concept underlying the present invention is to let any flow segment join the outlet flow not at once, but distributed over a certain time or volume window, the fraction joining the outlet flow at any moment being determined by the desired mixing function. This allows for a continuous dispersion of the fluid property which is intended to be mixed, for instance to be homogenized, in accordance with a predefined fluid distribution function. Hereby the flow distribution is particularly achieved by moving the fractions of the flow segments with varying flow volumes thus obtaining different segment contributions at different times at the outlet which provide the wished flow distribution function.

In more detail, the proposed continuous mixing is achieved by applying to the fluid the combination of moving partial flows of the fluid with stepwise or continuously different time delays and using different flow volumes for the retarded partial flows. A preferred distribution function is a Gaussian profile. The advantage of a dispersing mixer with a Gauss-function or generally a smooth continuous function is that it is much more efficient than one consisting of only two pathways with an equal cross-section and thus having a mixing function of two narrow peaks, the difference being not only quantitative, but qualitative.

A further advantage over the apparatus according to JP 54-128863 A is that the method of mixing or dispersing fluids according to the invention has not only an optimal efficiency at certain periods of fluctuations but is efficient in a broad range of fluctuation periods as well as for non-periodic fluctuations.

The proposed method allows for a mixing appliance with minimum volume which disperses the zones with fluctuations of the fluid properties according to a desired predefined mixing function. A desired function is achieved by establishing the segment distribution profile and the distance to be covered by different partial flows so that each fluid segment is distributed to a desired profile.

The proposed method further allows to realize a mixing device with immediate response, i.e. the first fractions of a flow segment progress to the outlet immediately.

Computer simulations have shown that, by a given mixing volume, the best fluctuation-smoothing effect can be achieved using a Gauss or similar mixing or filtering function. This can be achieved with the proposed method by dispersing each portion of the eluent to a zone with the desired concentration profile in the outlet flow.

The method can advantageously be realized by splitting the fluid into numerous partial flows with varying flow volumes and by delaying each of the partial flows with a different flow delay.

Hereby the varying of the flow volumes can particularly be realized by a varying hydraulic resistance. Varying of the hydraulic resistance can further be realized by throttling the partial flows, particularly by using flow restrictors. The step of delaying the partial flows with the different flow delay can be provided by different flow lengths, or reservoirs to be flown through.

The proposed apparatus comprises means, arranged between the inlet component and the outlet component for delaying partial flows of the fluid with different flow delays and means for providing different flow volumes for the partial flows wherein the delayed partial flows with different flow volumes correspond to a predetermined flow distribution function.

In one embodiment, the apparatus comprises numerous flow channels, arranged between the inlet component and the outlet component, each with a different channel length and with a varying hydraulic resistance. Hereby the varying hydraulic resistance can be provided by different cross-sections of the respective channels.

According to another embodiment, the apparatus comprises a dispersion chamber, arranged between the inlet component and the outlet component, comprising a cross-sectional shape varying along the flow direction and by a slit fluidly connected to the dispersion chamber, wherein the cross-sectional shape corresponds to a predetermined flow distribution function. The distribution or dispersion, respectively, occurs as a flow progresses through the chamber with a non-uniform cross-section with the flow inlet at one end and with the flow outlet in the form of a narrow slit along one side of the chamber, opening to a flow outlet collector tube.

The chamber can be of uniform cross-section, the distribution function being determined exclusively by the form of the slit, namely the slit width at different distances along the slit.

According to yet another embodiment, the slit can be replaced through a number of restrictor channels, arranged between an inlet channel and an outlet channel with varying distances between each other, wherein the distribution of the restrictor channels with respect to the flow direction in the inlet channel corresponds to the predetermined flow distribution function. Hereby the chamber can be split to a number of smaller chambers of smaller volumes, each being equipped with its own restrictor channel.

All the mentioned method and apparatus features can be implemented in a macro-design for a common physical or chemical application or in a micro-design, e.g. an on-a-chip design for microfluidics applications.

BRIEF DESCRIPTION OF THE DRAWINGS

In the following, the invention is described in more detail by way of embodiments and with reference to the accompanying drawings where identical or functionally similar features are designated with identical reference numerals. In more detail.

DETAILED DESCRIPTION OF THE INVENTION

Figure 1:
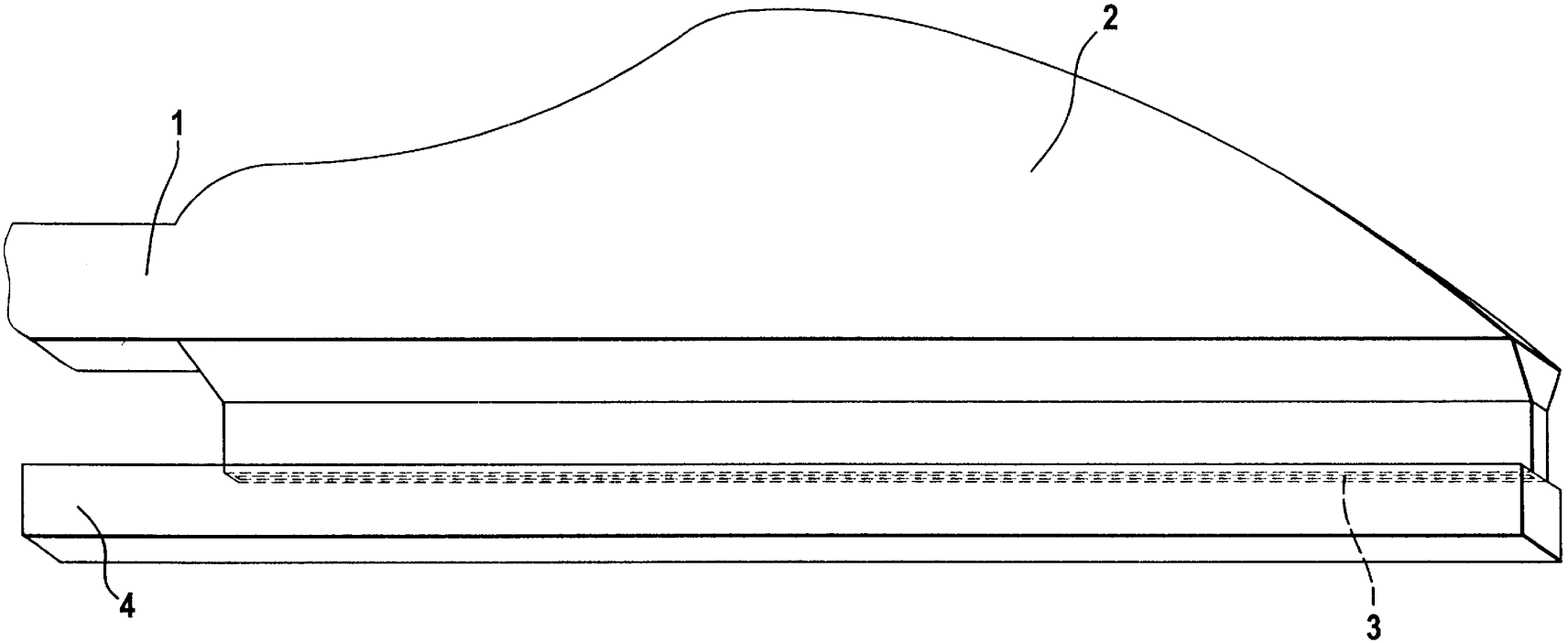
FIG. 1 shows an embodiment of the apparatus of the present invention comprising a complex-shaped chamber and a connected slit.

FIG. 1 shows a first embodiment of an apparatus according to the invention which comprises a complex shaped chamber with a slit. The fluid, which is a liquid in the present and the following embodiments, is progressing from an inlet tubing 1 to an outlet tubing 4. Every segment of the liquid is part by part transferred to the outlet channel via the slit 3 as it proceeds along the chamber 2 and thus is distributed over the outlet flow in the desired distribution pattern.

Figure 2:
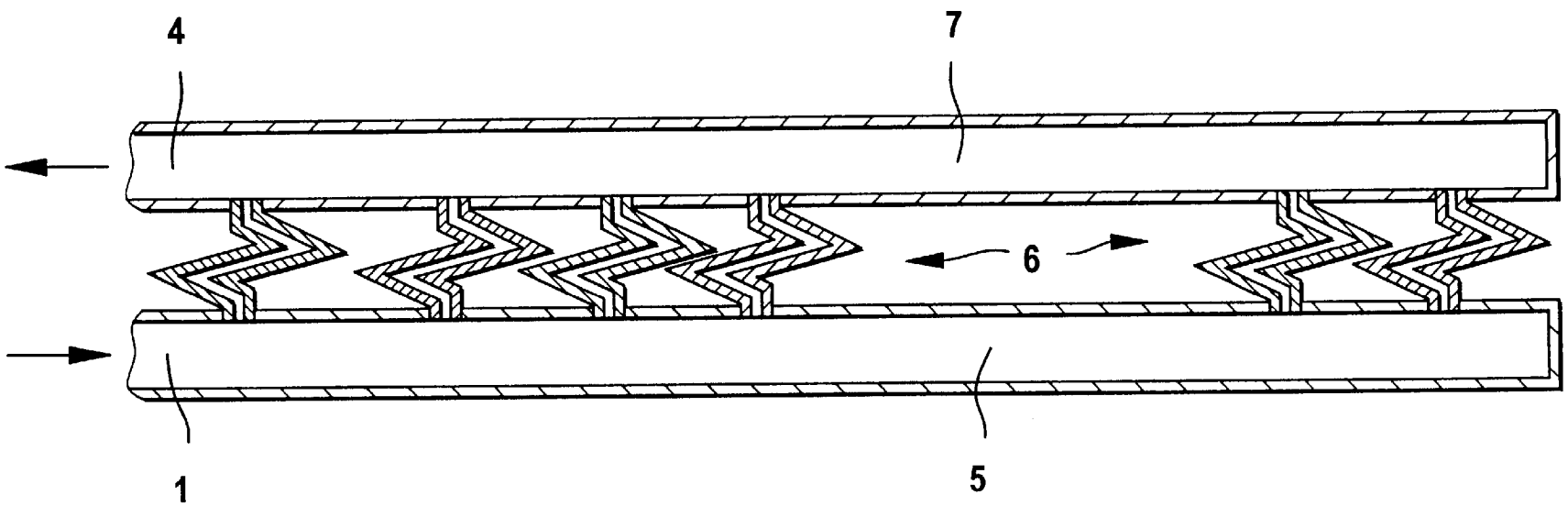
FIG. 2 shows another embodiment where the continuous slit of FIG. 1 is replaced by numerous restrictor channels.

FIG. 2 shows another embodiment where the design of FIG. 1 which is difficult to calculate is simplified using a chamber with constant or a simply to describe cross-section and where numerous narrow outlet or restrictor channels 6, which are connected to an inlet reservoir channel 5, are gathered to an outlet reservoir channel (collector) 7, instead of the slit of complex shape. The distances between the restrictor channels 6 determine the dispersion pattern for any segment of the flow, progressing from the inlet chamber in the form of a reservoir channel 5 to the Outlet 4. In other words, the nearer the outlet channels are placed one to another, the higher is the permeability to the outlet collector at the respective location, thus having the same effect as a wider outlet slit.

Figure 3:
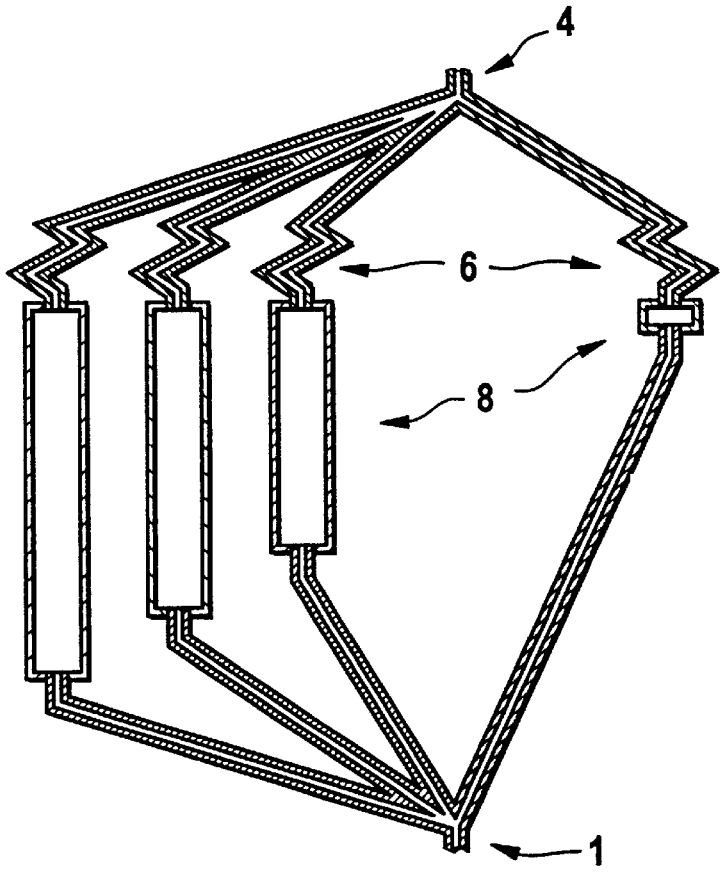
FIG. 3 shows a further embodiment of the apparatus of the invention which comprises a number of channel reservoirs and connected restrictors.

FIG. 3 depicts a further embodiment of the mixing apparatus according to the invention. The functional principle is the same as in FIG. 2, but the dispersion is achieved not by sequential progress of a liquid segment into the outlet flow, but by parallel propagation of its fractions in the different ways through the volumes of the reservoirs 8 thus determining the dispersion pattern for any segment of the flow.

Figure 4:
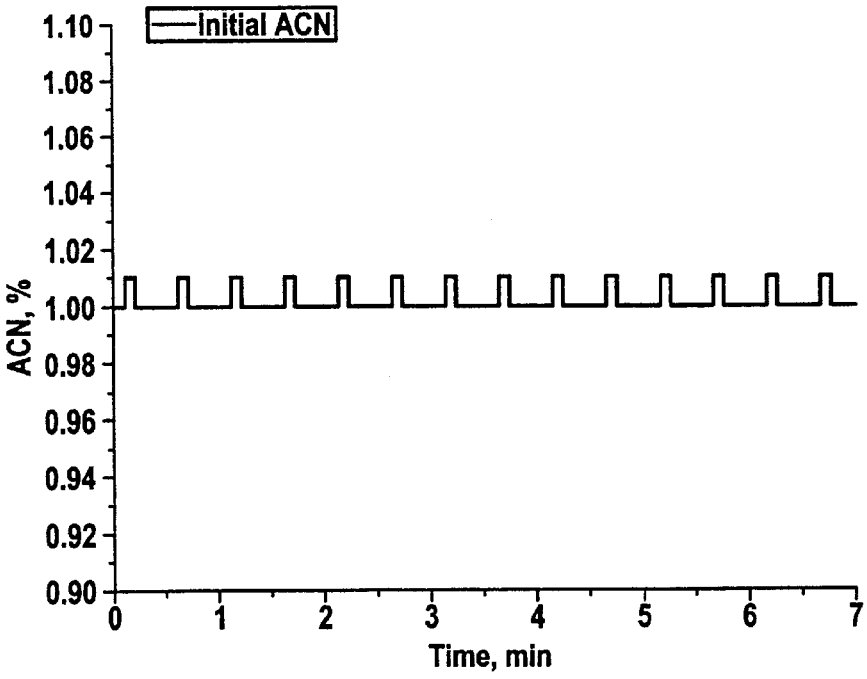
FIG. 4 depicts a modeled initial property fluctuation profile.

The curve depicted in FIG. 4 is a modeled initial property fluctuation profile. For simplification purposes and in order to enable comparison of the apparatus of the present invention with the apparatus disclosed in JP 54-128863 A, a simple periodic step-function is used.

Figure 5A:
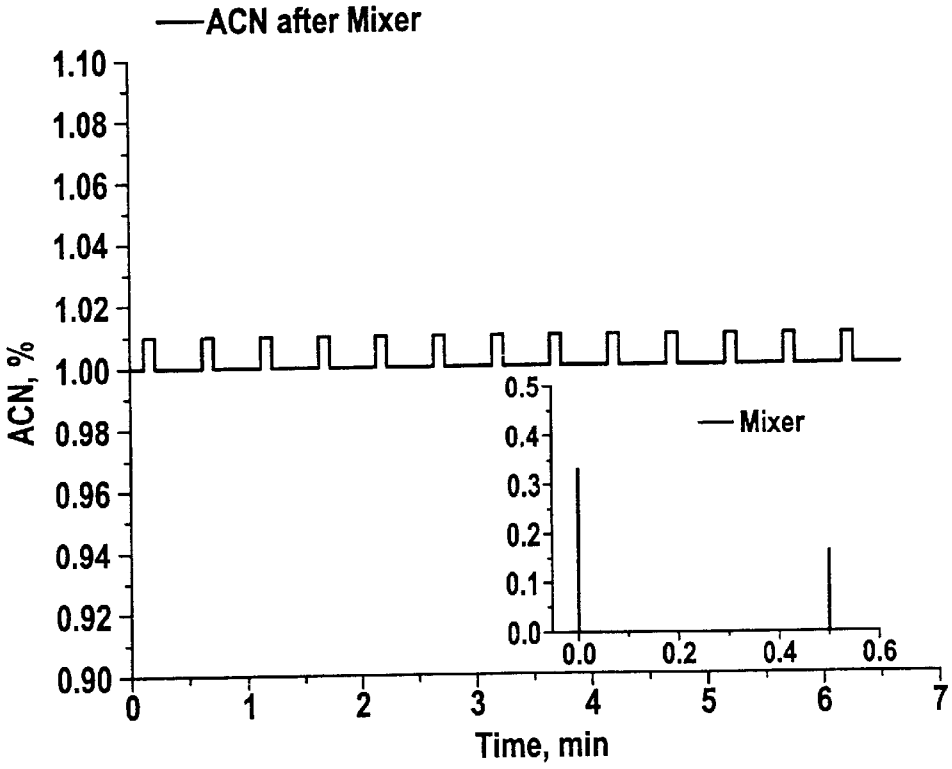
FIGS. 5*a, b* shows the property fluctuation profile of FIG. 4 after mixing in accordance with JP 54-128863 A.

FIG. 5*a* depicts the property fluctuations achieved after mixing the profile of FIG. 4 with a mixer disclosed in JP 54-128863 A. Inserts in the plots depict the corresponding mixing function. The mixing function of the mixer disclosed in JP 54-128863 A consists of two delta-functions (spikes). The different Y-axis scales are to be noted.

The example depicted in FIG. 5*a* is an unfavorable combination of the period of the pulsations of the initial profile and the mixer parameters. Hereby the pulse period of the initial pulse pattern and the mixer differential delay volume, which is defined by the difference of the lengths of the two channels, are identical. The resulting curve shows only a negligible mixing or smoothing effect.

In contrast to FIG. 5*a*, shows 5*b* a resulting curve for the mixer disclosed in JP 54-128863 A where a more favorable combination of the periods of the pulsations and mixer parameters is used. The smoothing results in two discrete step-functions with amplitudes differing with about a factor of 2 from each other.

Figure 6:
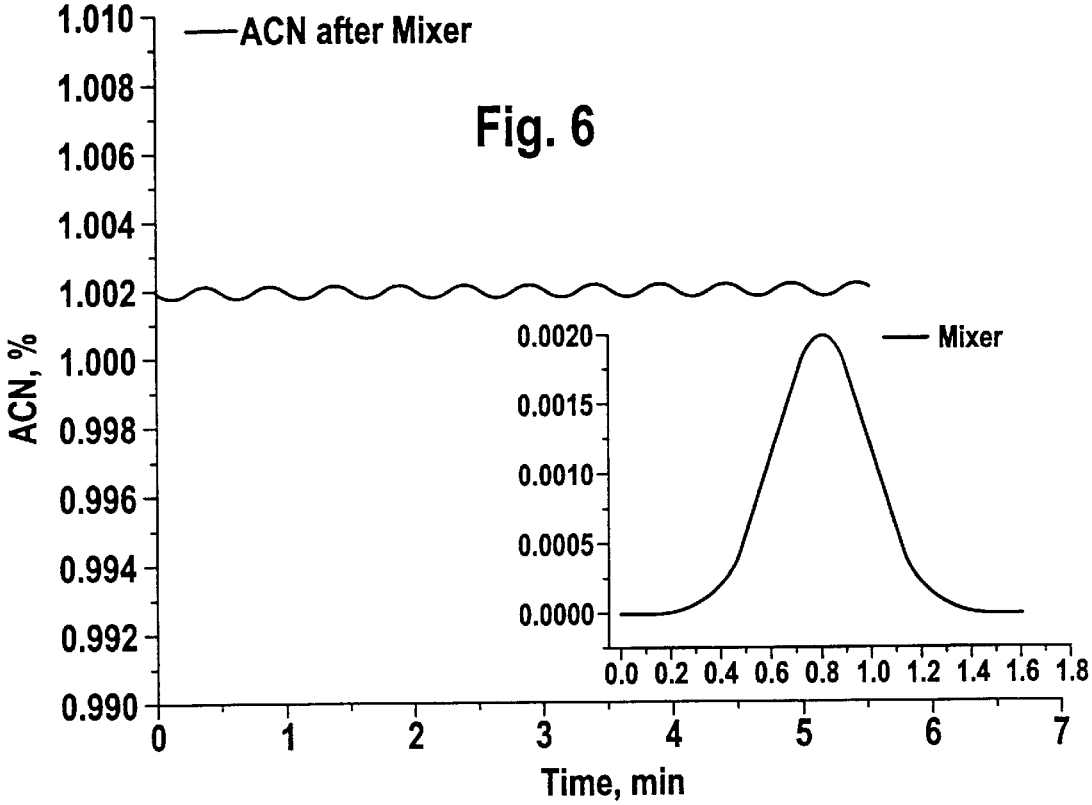
FIG. 6 shows a property fluctuation profile after dispersing the profile of FIG. 4 with a mixer according to the invention.

FIG. 6 shows a resulting mixing curve obtained with a mixing apparatus according to the present invention. As distribution function a Gauss-function is used. In view of the different Y-axis scales used for FIGS. 5*a, b* and FIG. 6, the smoothing effect depicted in FIG. 6 is more than a magnitude (factor of 10) better than the effect obtained by the apparatus of JP 54-128863 A.

Figure 7:
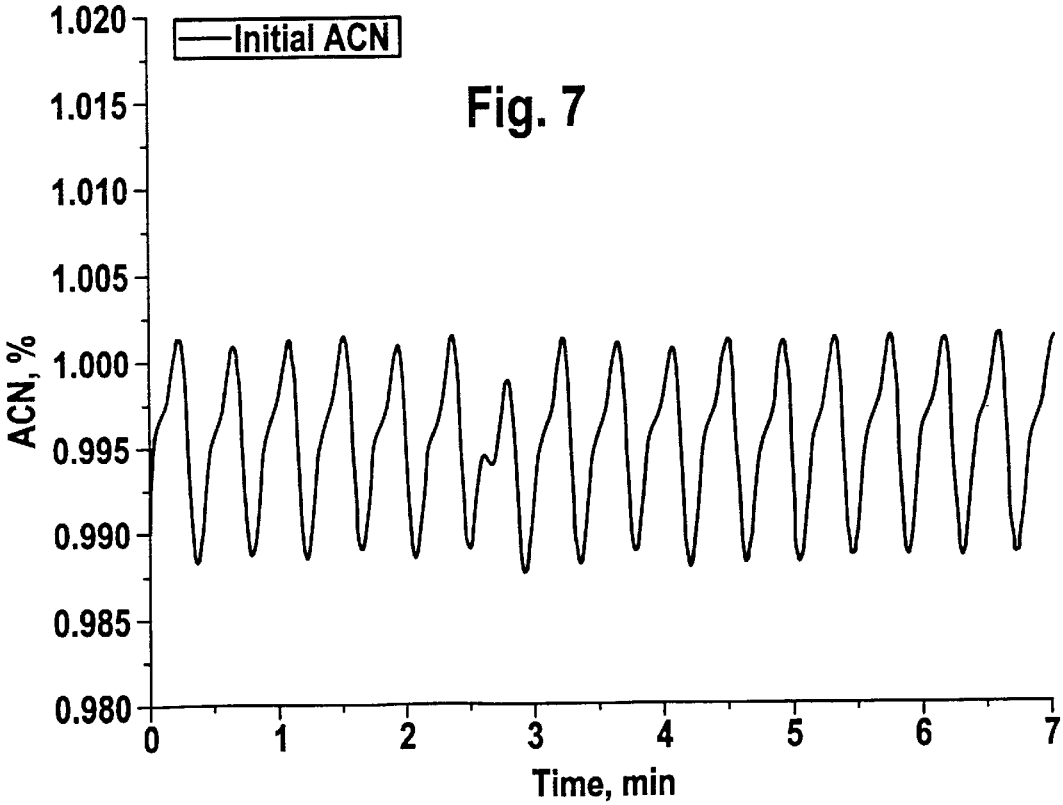
FIG. 7 depicts an initially measured property fluctuation profile in a real measurement for a chromatographic system.

FIG. 7 depicts an initially measured property fluctuation profile in a real measurement for a chromatographic system which is non-regular but nearly periodic.

Figure 5B:
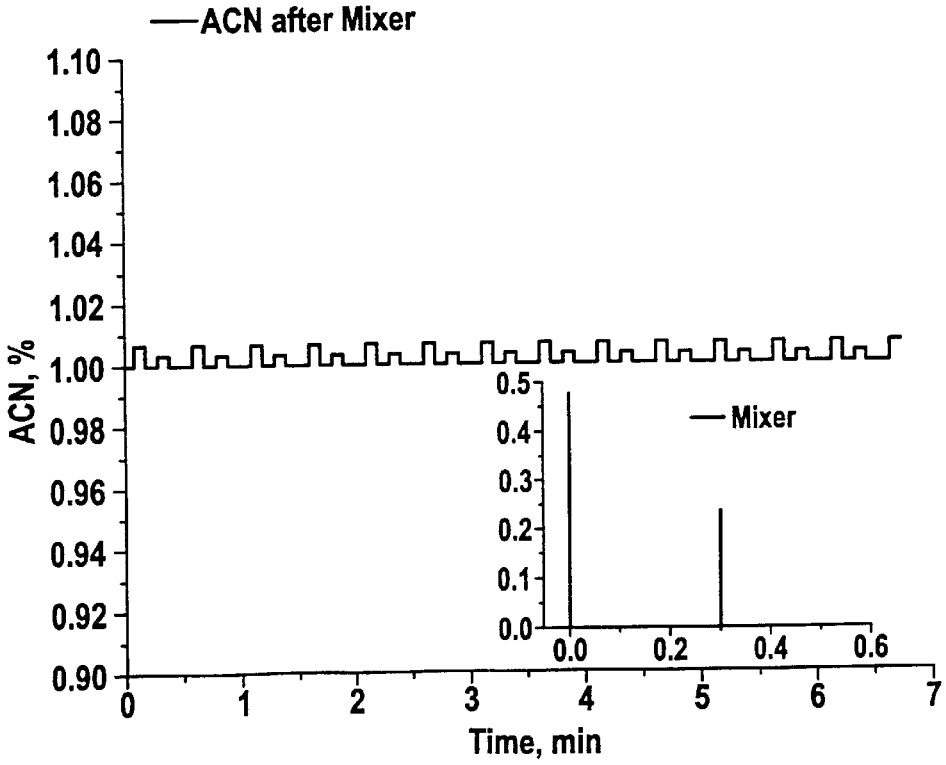
Figure 8A:
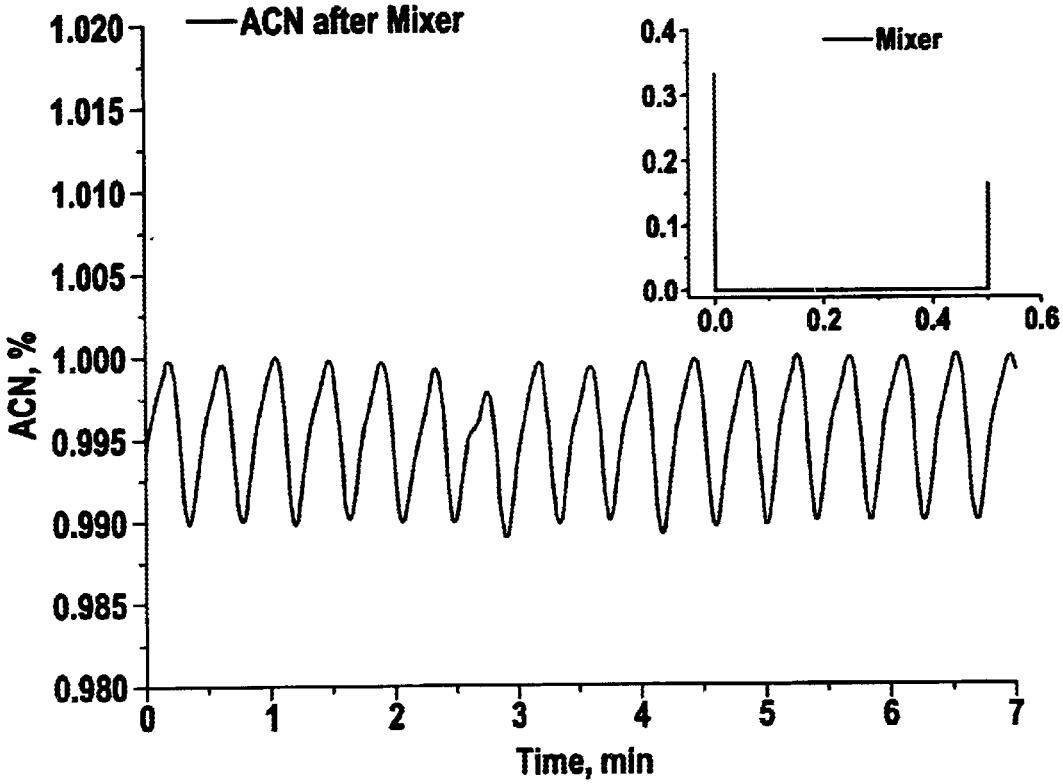
FIGS. 8*a, b* shows a property fluctuation profile after mixing in accordance with JP 54-128863 A derived from FIG. 7.
Figure 8B:
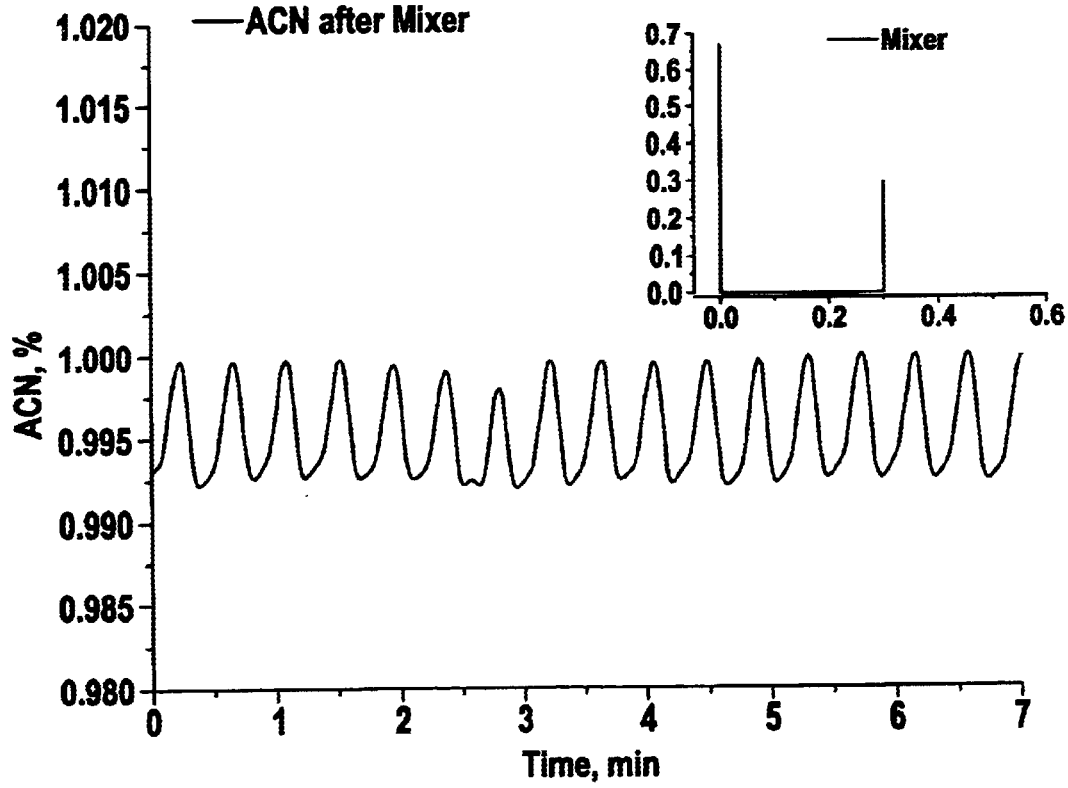
Figure 9:
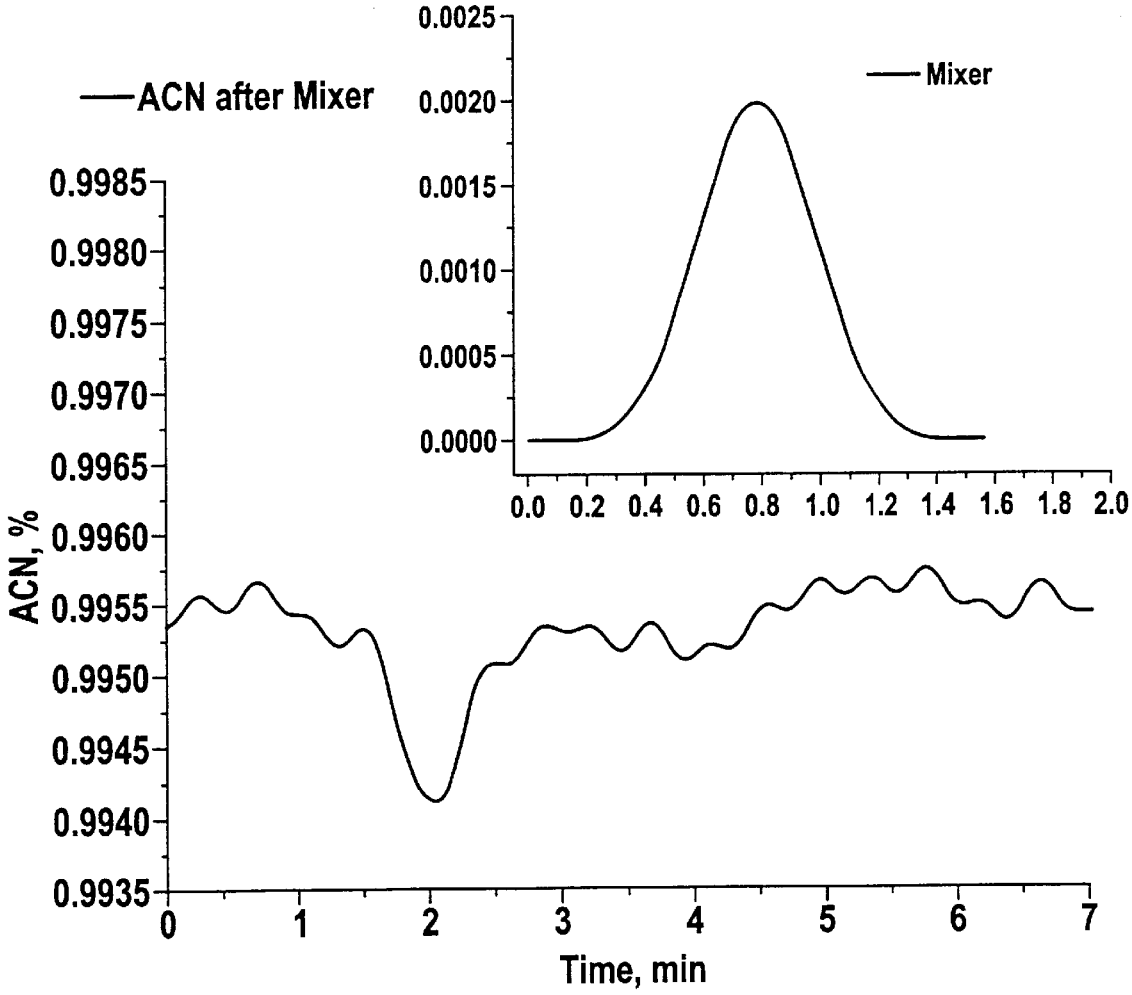
FIG. 9 shows a property fluctuation profile after dispersing the profile of FIG. 7 with a mixer according to the invention.

FIGS. 8*a* and 8*b* show mixing curves obtained by the apparatus of JP 54-128863 A for the fluctuation profile depicted in FIG. 7. The smoothing effect is comparable to that shown in FIGS. 5*a* and 5*b* and thus negligible, too FIG. 9 shows the property fluctuation profile after dispersing the profile of FIG. 7 with a mixer according to the invention. It is noted that the smoothing effect is about a factor of 5 better than that achieved by an apparatus according to JP 54-128863 A, as shown in FIG. 8*b*.

Practically, the mixer with a number of flow path channels can be built in following easily computable designs:

1. A "serial splitter" where the incoming flow is passing through a main channel with branching restrictor channels which are then unified again. The distances or volumes between the branching restrictor channels are chosen so as to produce the desired distribution of each elementary portion of the fluid over the output flow, wherein the hydraulic or flow resistance determines the portion of the flow passing through a given restrictor (FIG. 2);

2. A "parallel splitter" where an incoming flow is immediately split to a number of channels, each having a desired volume and hydraulic resistance determining the portion of the flow passing through the channel; the distribution profile in the outlet flow is entirely defined by the predesigned dead volumes of the restrictor channels whereby the volume of the inlet chamber is negligible;

3. A "mixed splitter" where both above approaches are combined, e.g. restrictor channels of a "serial splitter" are equipped with additional reservoirs i.e. delay volumes.

The above described restrictor channels can be of equal or different hydraulic resistance. The restrictors can be formed as narrow channels or capillaries. The reservoirs as well as the restrictors can be formed as continuous structures, e.g. as grooves or slits having a complex depth profile and being connected to one another on the whole length.

The structure can be planar, the grooves of different width and depth forming the desired system of reservoirs and restrictors. Any part of the appliance can be non-planar, e.g. the restrictor drillings can connect two sides of a plane block, bearing reservoir grooves on each side.

The grooves in a planar structure can be wave-formed or curved to improve radial mixing i.e. mixing of several eluent components flowing side-by-side.

The structure can be of annular design, formed as a system of parallel drillings in a cylinder block, one end of each drilling being connected to the mixer inlet, the other end of each drilling being connected to the mixer outlet. Each drilling consisting of two parts with different diameters, the wider serving as a reservoir, the narrower serving as a restrictor.

What is claimed is:

1. An apparatus for mixing a fluid, particularly a liquid or a gas, whereby the fluid comprises at least one physical and/or chemical property varying along a flow direction of the fluid, the apparatus comprising:

an inlet component and an outlet component, first means, arranged between the inlet component and the outlet component for delaying partial flows of the fluid with different flow delays; and second means for providing different flow volumes for the partial flows wherein the delaying partial flows with different flow volumes corresponds to a predetermined flow distribution function, wherein a plurality of flow channels are arranged between the inlet component and the outlet component, each with a different channel length and with a varying hydraulic resistance.

2. Apparatus according to claim 1, wherein the hydraulic resistance is varied by different cross-sections of the respective channels.

3. An apparatus for mixing a fluid, particularly a liquid or a gas, whereby the fluid comprises at least one physical and/or chemical property varying along a flow direction of the fluid, the apparatus comprising:

an inlet component and an outlet component, a dispersion chamber, arranged between the inlet component and the outlet component, said dispersion chamber comprising a cross-sectional shape varying along the flow direction and by a slit fluidly connected to the dispersion chamber for delaying partial flows of the fluid with different flow delays; and means for providing different flow volumes for the partial flows wherein the delaying partial flows with different flow volumes corresponds to a predetermined flow distribution function.

4. An apparatus for mixing a fluid, particularly a liquid or a gas, whereby the fluid comprises at least one physical and/or chemical property varying along a flow direction of the fluid, the apparatus comprising:

an inlet component and an outlet component, first means, arranged between the inlet component and the outlet component for delaying partial flows of the fluid with different flow delays;

second means for providing different flow volumes for the partial flows wherein the delaying partial flows with different flow volumes corresponds to a predetermined flow distribution function; and numerous restrictor channels, arranged between an inlet channel and an outlet channel with varying distances between each other, wherein the distribution of the restrictor channels with respect to the flow direction in the inlet channel corresponds to the predetermined flow distribution function.

* * * * *